US006804839B1

(12) United States Patent
McMaster

(10) Patent No.: US 6,804,839 B1
(45) Date of Patent: Oct. 19, 2004

(54) COMBINATION TOILET BRUSH/PLUNGER APPARATUS

(76) Inventor: Randy McMaster, 85 Grumman Ave., Newark, NJ (US) 07112

( * ) Notice: Subject to any disclaimer, the term of this patent is extended or adjusted under 35 U.S.C. 154(b) by 2 days.

(21) Appl. No.: 10/356,753

(22) Filed: Feb. 3, 2003

(51) Int. Cl.[7] ..... A47K 11/10
(52) U.S. Cl. ..... 4/255.11; 4/255.01; 206/15.3
(58) Field of Search ..... 4/255.01, 255.11, 4/255.12; 15/106; 206/15.2, 15.3, 361, 373, 374, 375

(56) References Cited

U.S. PATENT DOCUMENTS 1,710,127 A * 4/1929 Vaughn ..... 15/106
2,229,084 A 1/1941 Horne
4,008,933 A * 2/1977 Wanek ..... 312/206
4,700,423 A 10/1987 Zuliani
5,440,775 A 8/1995 Banks
5,617,605 A 4/1997 Hoerner et al.
5,971,141 A * 10/1999 Shafik ..... 206/361 X
6,367,621 B1 * 4/2002 Johnson ..... 206/15.3

* cited by examiner

*Primary Examiner*—Robert M. Fetsuga

(57) ABSTRACT

A combination toilet brush/plunger apparatus for providing both a plunger and a toilet cleaning brush in one convenient unit. The combination toilet brush/plunger apparatus includes a brush assembly including a brush support member, and also including a brush member being attached to the brush support member, and further including an elongate handle member being removably attached to the brush support member; and also includes a plunger assembly including a housing/support member and also including a plunger member being attached to the housing/support member with the brush support member being removably fastened to the housing/support member; and further includes a brush protective guard assembly being removably disposed in the housing/support member.

8 Claims, 3 Drawing Sheets

COMBINATION TOILET BRUSH/PLUNGER APPARATUS

BACKGROUND OF THE INVENTION

1. Field of the Invention

The present invention relates to combination plungers/brushes and more particularly pertains to a new combination toilet brush/plunger apparatus for providing both a plunger and a toilet cleaning brush in one convenient unit.

2. Description of the Prior Art

The use of combination plungers/brushes is known in the prior art. More specifically, combination plungers/brushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,617,605; U.S. Pat. No. 5,440,775; U.S. Pat. No. 4,700,423; U.S. Pat. No. 2,229,084; U.S. Pat. No. 2,026,680; and U.S. Pat. No. Des. 155,489.

While these devices fulfill their respective, particular objectives and requirements, the aforementioned patents do not disclose a new combination toilet brush/plunger apparatus. The prior art includes brushes having cleaning heads and handles attached thereto and also includes separate plungers having suction cups attached to handles.

SUMMARY OF THE INVENTION

The general purpose of the present invention, which will be described subsequently in greater detail, is to provide a new combination toilet brush/plunger apparatus which has many of the advantages of the combination plungers/brushes mentioned heretofore and many novel features that result in a new combination toilet brush/plunger apparatus which is not anticipated, rendered obvious, suggested, or even implied by any of the prior art combination plungers/brushes, either alone or in any combination thereof. The present invention includes a brush assembly including a brush support member, and also including a brush member being attached to the brush support member, and further including an elongate handle member being removably attached to the brush support member; and also includes a plunger assembly including a housing/support member and also including a plunger member being attached to the housing/support member with the brush support member being removably fastened to the housing/support member; and further includes a brush protective guard assembly being removably disposed in the housing/support member. None of the prior art includes the combination of the elements of the present invention.

There has thus been outlined, rather broadly, the more important features of the combination toilet brush/plunger apparatus in order that the detailed description thereof that follows may be better understood, and in order that the present contribution to the art may be better appreciated There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new combination toilet brush/plunger apparatus which has many of the advantages of the combination plungers/brushes mentioned heretofore and many novel features that result in a new combination toilet brush/plunger apparatus which is not anticipated, rendered obvious, suggested, or even implied by any of the prior art combination plungers/brushes, either alone or in any combination thereof.

Still another object of the present invention is to provide a new combination toilet brush/plunger apparatus for providing both a plunger and a toilet cleaning brush in one convenient unit.

Still yet another object of the present invention is to provide a new combination toilet brush/plunger apparatus that is easy and convenient to set up and use.

Even still another object of the present invention is to provide a new combination toilet brush/plunger apparatus that eliminates the need for having a separate plunger and a separate toilet cleaning brush.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
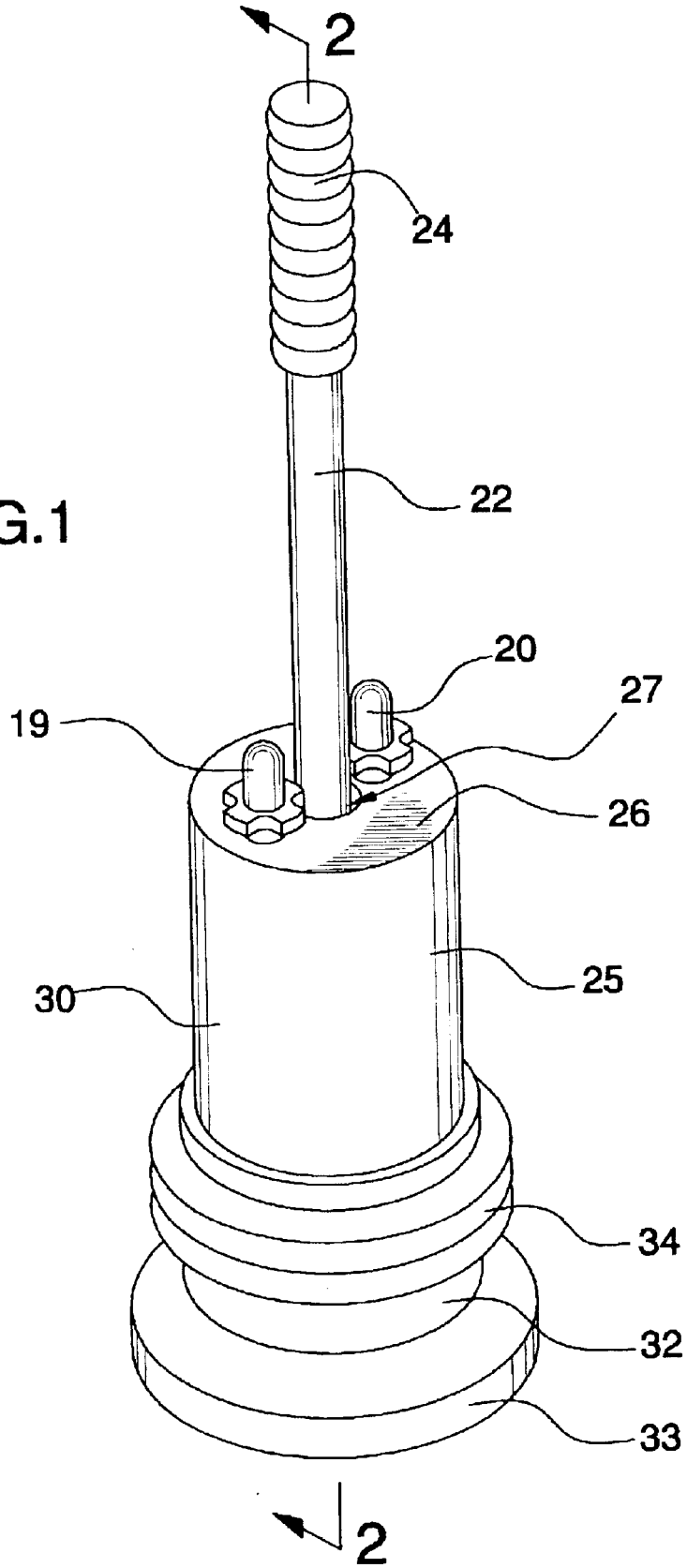
FIG. 1 is a perspective view of a new combination toilet brush/plunger apparatus according to the present invention.
Figure 2:
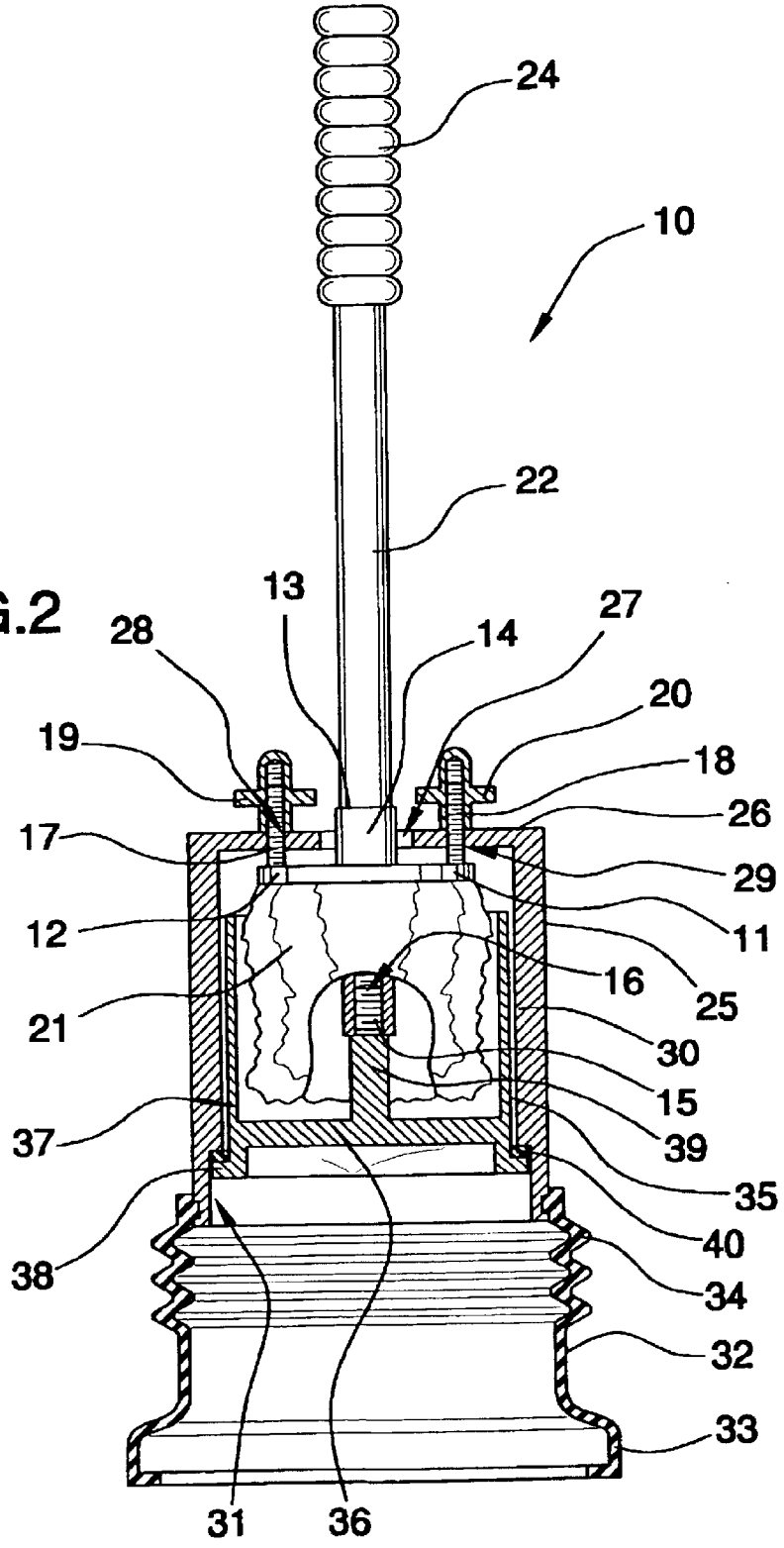
FIG. 2 is a cross-sectional view of the present invention.
Figure 3:
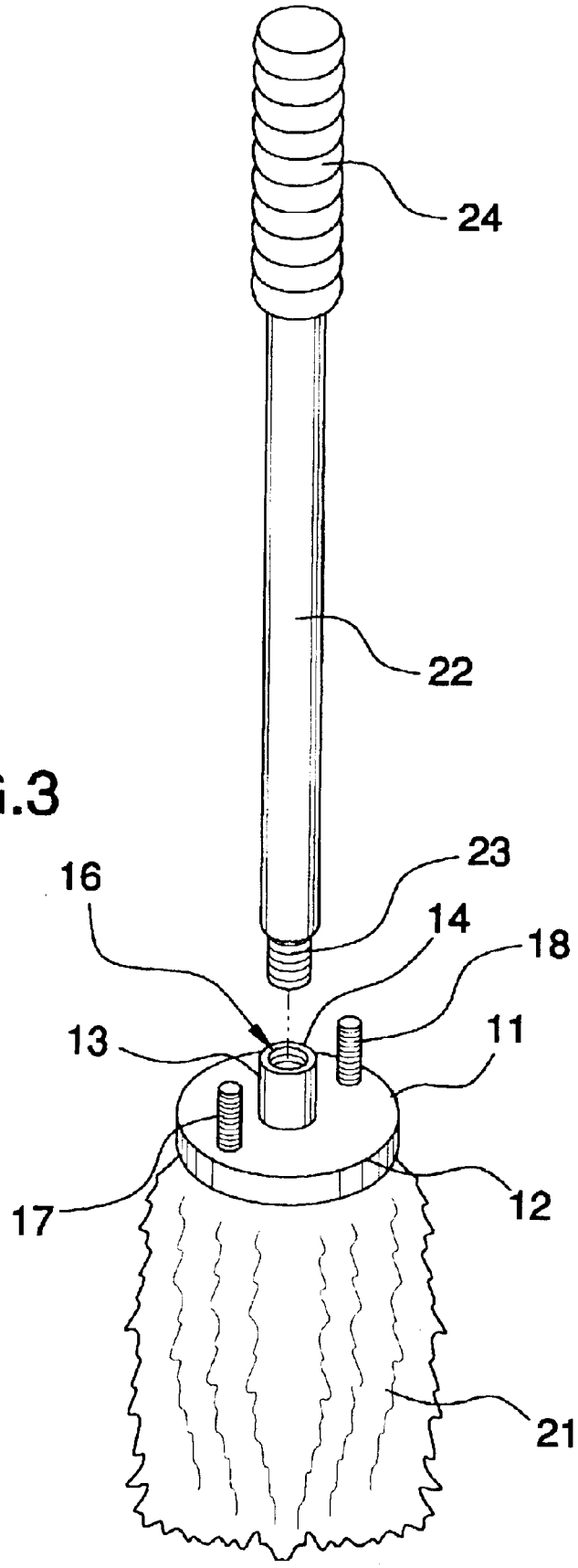
FIG. 3 is an exploded perspective view of the brush of the present invention.

With reference now to the drawings, and in particular to FIGS. 1 through 3 thereof, a new combination toilet brush/plunger apparatus embodying the principles and concepts of the present invention and generally designated by the reference numeral 10 will be described.

As best illustrated in FIGS. 1 through 3, the combination toilet brush/plunger apparatus 10 generally comprises a brush assembly including a brush support member 11, and also including a brush member 21 being attached in a conventional manner to the brush support member 11, and further including an elongate handle member 22 being removably attached and fastened to the brush support member 11. The brush support member 11 includes plate 12, and also includes a tubular connector 13 being centrally disposed in and through the plate 12 and having open top and bottom ends 14,15 and a bore 16 extending therethrough, and further includes elongate threaded members 17,18 being conventionally attached to a top side of the plate 12, and also includes fasteners 19,20 being threaded on the elongate threaded members 17,18. The brush member 21 is securely attached to a bottom side of the plate 12, and is made of pliable material. The handle member 22 has an annular recessed bottom end portion 23 which is removably threaded into the top end 14 of the tubular connector 13, and also has a ribbed end portion 24 for a user to easily grip the handle member 22.

A plunger assembly includes a housing/support member 25 and also includes a plunger member 32 being securely attached to the housing/support member 25 with the brush support member 11 being removably fastened to the housing/support member 25. The housing/support member 25 has top and side walls 26,30, and an open bottom. The top wall 26 has an opening 27 being centrally-disposed therethrough and also having holes 28,29 being disposed therethrough near a perimeter of the top wall 26. The side wall 30 has a recessed inner side bottom portion 31. The elongate threaded members 17,18 of the brush support member 11 are removably disposed through the holes 28,29 of the housing/support member 25 and are fastenable to the housing/support member 25 with the fasteners 19,20. The plunger member 32 is generally a suction cup having a bottom portion 33 and an accordion top portion 34 which is conventionally attached to the side wall 30 and about the open bottom of the housing/support member 25.

A brush protective guard assembly is removably disposed in the housing/support member 25. The brush protective guard assembly includes a cylindrical member 35 having bottom and side walls 36,37 and an open top and being securely and removably seated in the open bottom of the housing/support member 25, and also includes a threaded post member 39 being conventionally attached to a top side of bottom wall 36 of the cylindrical member 35 and upon which the tubular connector 13 is threaded, and further includes an O-ring seal member 40 being disposed between the side wall 30 of the housing/support member 25 and the cylindrical member 35. The side wall 37 of the cylindrical member 35 extends below the bottom wall 36. The cylindrical member 35 further has a flange 38 being integrally attached to a bottom end of the side wall 37 and extending outwardly therefrom. The O-ring seal member 40 is disposed in the recessed inner side bottom portion 31 of the housing/support member 25 and being disposed between the side wall 30 of the housing/support member 25 and the flange 38 to protect the brush member 21.

In use, the user would place the bottom portion 33 of the plunger member 32 over the plugged hole in the toilet and would push down upon the plunger member 32 using the handle member 22 which creates suction in the hole of the toilet to unplug the hole. To clean the toilet bowl, the user would unfasten the fasteners 19,20 from the elongate threaded members 17,18 and would remove the cylindrical member 35 from the housing/support member 25, and then slide the brush member 21 and the handle member 22 out from the open bottom of the housing/support member 25 and would clean the toilet bowl using the brush member 21. When finished, the user simply fastens the brush member 21 in the housing/support member 25 and replaces the cylindrical member 35 in the open bottom of the housing/support member 25.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the combination toilet brush/plunger apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination toilet brush/plunger apparatus, wherein comprising:

a brush assembly including a brush support member, and also including a brush member being attached to said brush support member, and further including an elongate handle member being removably attached to said brush support member, said brush support member including a plate, and also including a tubular connector being centrally disposed in and through said plate and having open top and bottom ends and a bore extending therethrough, and further including elongate threaded members being attached to a top side of said plate, and also including fasteners being threaded on said elongate threaded members;

a plunger assembly including a housing/support member and also including a plunger member being attached to said housing/support member, said brush support member being removably fastened to said housing/support member; and a brush protective guard assembly being removably disposed in said housing/support member.

2. The combination toilet brush/plunger apparatus as described in claim 1, wherein said brush member is attached to a bottom side of said plate, and is made of pliable material.

3. A combination toilet brush/plunger apparatus as described in claim 2, wherein said handle member has an annular recessed bottom end portion which is removably threaded into said top end of said tubular connector, and also has a ribbed end portion for a user to easily grip said handle member.

4. The combination toilet brush/plunger apparatus as described in claim 3, wherein said housing/support member has top and side walls, and an open bottom, said top wall having an opening being centrally-disposed therethrough and also having holes being disposed therethrough near a perimeter of said top wall, said side wall having a recessed inner side bottom portion, said elongate threaded members of said brush support member being removably disposed through said holes of said housing/support member and being fastenable to said housing/support member with said fasteners.

5. The combination toilet brush/plunger apparatus as described in claim 4, wherein said plunger member is generally a suction cup having a bottom portion and an accordion top portion which is attached to said side wall and about said open bottom of said housing/support member.

6. The combination toilet brush/plunger apparatus as described in claim 5, wherein said brush protective guard assembly includes a cylindrical member having bottom and side walls and an open top and being securely and removably seated in said open bottom of said housing/support member, and also includes a threaded post member being attached to a top side of bottom wall of said cylindrical member and upon which said tubular connector is threaded, and further includes an O-ring seal member being disposed between said side wall of said housing/support member and said cylindrical member.

7. The combination toilet brush/plunger apparatus as described in claim 6, wherein said side wall of said cylindrical member extends below said bottom wall, said cylindrical member further having a flange being attached to a bottom end of said side wall and extending outwardly therefrom.

8. The combination toilet brush/plunger apparatus as described in claim 7, wherein said O-ring seal member is disposed in said recessed inner side bottom portion of said housing/support member and being disposed between said side wall of said housing/support member and said flange to protect said brush member.

* * * * *